US007752814B2

(12) United States Patent
Bonshor

(10) Patent No.: US 7,752,814 B2
(45) Date of Patent: Jul. 13, 2010

(54) WATER DEFLECTION APPARATUS FOR USE WITH A WALL MOUNTING BRACKET

(75) Inventor: David J. Bonshor, Surrey (CA)

(73) Assignee: Tapco International Corporation, Wixom, MI (US)

( * ) Notice: Subject to any disclaimer, the term of this patent is extended or adjusted under 35 U.S.C. 154(b) by 812 days.

(21) Appl. No.: 11/390,071

(22) Filed: Mar. 28, 2006

(65) Prior Publication Data

US 2006/0213132 A1 Sep. 28, 2006

Related U.S. Application Data

(60) Provisional application No. 60/665,192, filed on Mar. 28, 2005.

(51) Int. Cl.
*E04D 1/36* (2006.01)
*E04D 15/00* (2006.01)

(52) U.S. Cl. ..... 52/61; 52/97; 52/60

(58) Field of Classification Search ..... 52/60, 52/61, 199, 212, 473, 716.2, 220.8, 302.6, 52/209, 11, 12, 13, 14, 15, 16
See application file for complete search history.

(56) References Cited

U.S. PATENT DOCUMENTS 2,777,405 A * 1/1957 Ager ..... 52/16
4,112,691 A * 9/1978 Ebeling et al. ..... 405/119
4,381,063 A 4/1983 Leong
4,391,068 A * 7/1983 Kosar ..... 52/97
4,596,948 A 6/1986 Wall
4,646,488 A 3/1987 Burns
4,726,152 A 2/1988 Vagedes et al.
4,875,318 A 10/1989 MacLeod et al.
4,920,708 A * 5/1990 MacLeod et al. ..... 52/60
4,956,948 A * 9/1990 Hart ..... 52/16
5,000,409 A 3/1991 MacLeod et al.
5,018,333 A 5/1991 Bruhm
5,133,165 A 7/1992 Wimberly
5,303,522 A 4/1994 Vagedes
5,326,060 A 7/1994 Chubb et al.
5,369,922 A 12/1994 Hansen
5,397,093 A 3/1995 Chubb et al.
5,549,266 A * 8/1996 Mitchell et al. ..... 248/205.1
5,594,206 A 1/1997 Klas et al.
5,675,940 A 10/1997 Bahar et al.
5,722,208 A * 3/1998 Humphrey et al. ..... 52/220.8

(Continued)

*Primary Examiner*—Brian E Glessner
*Assistant Examiner*—Omar Hijaz
(74) *Attorney, Agent, or Firm*—Howard & Howard Attorneys PLLC

(57) ABSTRACT

A water deflecting apparatus comprises a mounting plate with a back surface and a front surface. The back surface of the mounting plate abuts the wall when the water deflecting apparatus is mounted to the wall. A deflector extends outwardly from the front surface of the mounting plate near each end of the mounting plate. The mounting plate of the wall mounting bracket is received between the deflectors when the water deflecting apparatus and the wall mounting bracket are mounted to the wall. The deflectors deflect the downward flow of water. A skirt extends between the deflectors and outwardly from the front surface of the mounting plate of the water deflecting apparatus. The skirt is located below the mounting plate of the wall mounting bracket and is received between the deflectors when the water deflecting apparatus and the wall mounting bracket are mounted to the wall.

20 Claims, 10 Drawing Sheets

U.S. PATENT DOCUMENTS 5,918,431 A 7/1999 Schiedegger et al.
6,070,375 A 6/2000 Anderson et al.
6,076,310 A 6/2000 Kim
6,098,343 A * 8/2000 Brown et al. ..... 52/11
6,119,416 A 9/2000 Larson
6,151,838 A * 11/2000 Husein ..... 52/58
6,155,008 A 12/2000 McKee
6,429,371 B2 8/2002 Schiedegger et al.
6,553,735 B1 4/2003 Chen
D475,440 S * 6/2003 Sawyer ..... D23/267
6,610,927 B2 8/2003 Dinh et al.
6,780,100 B1 8/2004 Gretz
6,825,414 B2 11/2004 Vagedes
6,904,725 B1 6/2005 Hansen et al.
6,951,081 B2 * 10/2005 Bonshor ..... 52/97
RE38,881 E * 11/2005 Chubb et al. ..... 248/231.9
7,096,627 B2 * 8/2006 Wade ..... 52/12
7,107,736 B2 9/2006 Barnard
2001/0015281 A1 8/2001 Schiedegger et al.
2003/0041539 A1 3/2003 Bernacki et al.
2003/0136060 A1 * 7/2003 Bonshor ..... 52/97
2006/0277857 A1 * 12/2006 Bonshor ..... 52/518

* cited by examiner

WATER DEFLECTION APPARATUS FOR USE WITH A WALL MOUNTING BRACKET

CROSS REFERENCE TO RELATED APPLICATION

This application claims the benefit of provisional application No. 60/665,192 filed on Mar. 28, 2005.

BACKGROUND OF THE INVENTION

The present invention relates to a water deflection apparatus and in particular to a water deflection apparatus for use with a wall mounting bracket.

Buildings and other structures with siding overlays such as vinyl or aluminum siding are often provided with external fixtures which serve both functional and decorative purposes. For example lights, electrical outlets and decorative items such as address numbers are often mounted on the outside of buildings and other structures with siding overlays. Due to the stepped and uneven surface of the siding, wall mounting brackets are often used in conjunction with the siding to provide a flat surface on which to mount the external fixtures.

It can be appreciated that a hole must be cut in the siding in order to install the wall mounting brackets. The continuous surface of the siding is therefore interrupted and the water-shedding capability of the siding is compromised by water seeping into the cut hole. There is therefore a need for a water deflection apparatus that may be used in conjunction with a separate wall mounting bracket to deflect water that has seeped into the cutout and may be introduced behind the surface of the siding where rot or other damage may occur.

It is therefore an objective of the present invention to provide a water deflection apparatus for use with a separate wall mounting bracket when the water deflecting apparatus and the wall mounting bracket are both mounted to a wall. The wall mounting bracket has a mounting plate and a cover plate. The mounting plate and the cover plate of the wall mounting bracket are spaced-apart and allow for a downward flow of water therebetween. When used with the wall mounting bracket, the water deflection apparatus interrupts this downward flow of water and diverts it out over the top of the siding below the wall mounting bracket, thereby preventing the damage associated with water being introduced behind the siding.

SUMMARY OF THE INVENTION

There is provided a water deflection apparatus for use with a separate wall mounting bracket when the water deflecting apparatus and the wall mounting bracket are both mounted to a wall. The wall mounting bracket has a mounting plate and a cover plate. The mounting plate and the cover plate of the wall mounting bracket are spaced-apart and allow for a downward flow of water therebetween. When used with the wall mounting bracket, the water deflection apparatus deflects the downward flow of water away from the wall.

The water deflecting apparatus comprises its own mounting plate with a back surface and a front surface. The back surface of the water deflecting apparatus mounting plate abuts the wall when the water deflecting apparatus is mounted to the wall. A deflector extends outwardly from the front surface of the water deflecting apparatus mounting plate near each end of the water deflecting apparatus mounting plate. The mounting plate of the separate wall mounting bracket is received between the deflectors when the water deflecting apparatus and the wall mounting bracket are both mounted to the wall.

The deflectors deflect the downward flow of water. A skirt extends between the deflectors and outwardly from the front surface of the mounting plate of the water deflecting apparatus. The skirt is located below the mounting plate of the wall mounting bracket and is received between the deflectors when the water deflecting apparatus and the wall mounting bracket are both mounted to the wall, a portion of the mounting plate of the wall mounting bracket overlapping a portion of the front surface of the water deflecting apparatus mounting plate.

DETAILED DESCRIPTION OF THE PREFERRED EMBODIMENTS

Figure 1:
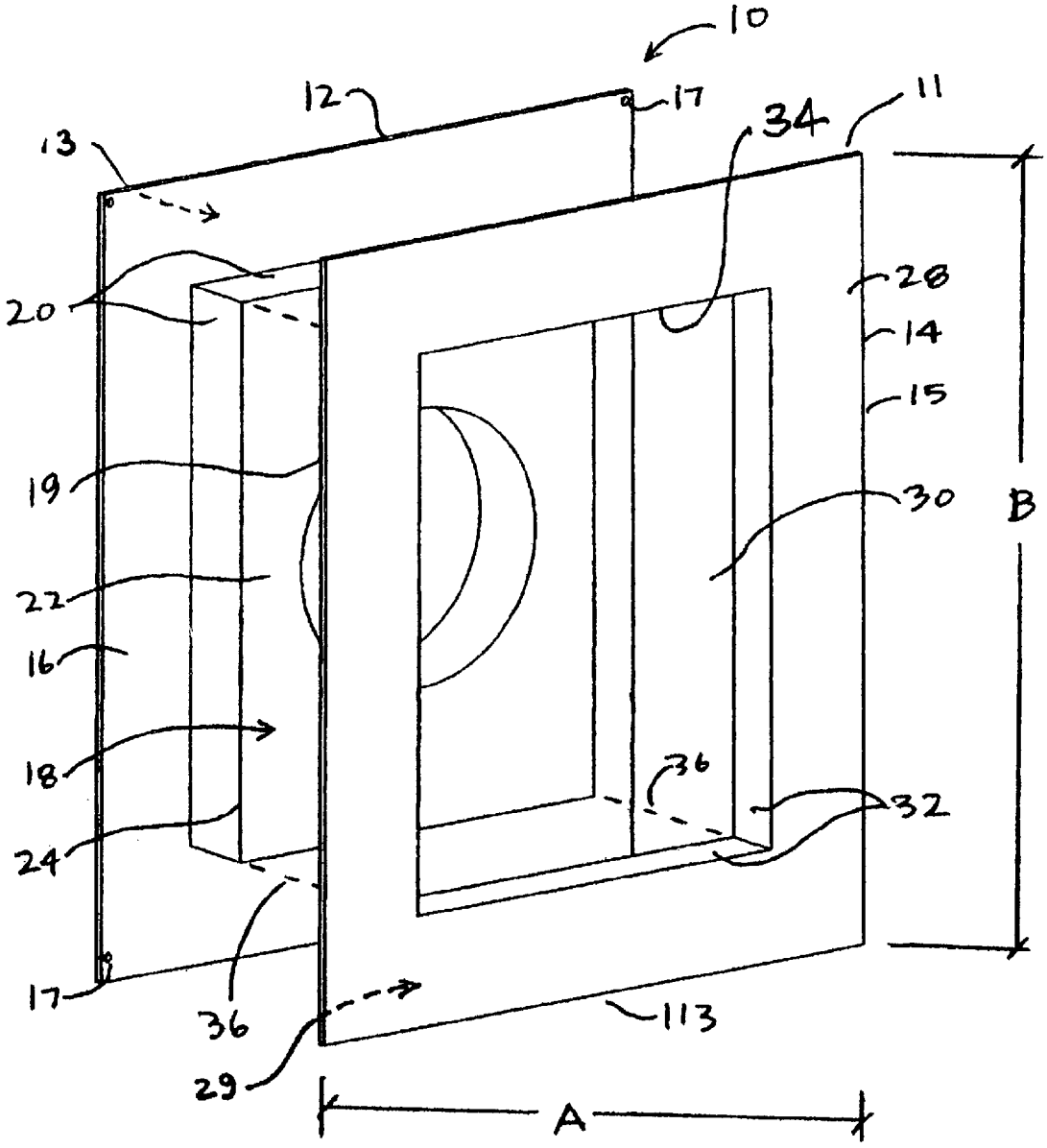
FIGURE 1 (prior art)
FIG. 1 is a front, partially exploded, isometric view showing a known wall mounting bracket.

Referring to the drawings and first to FIG. 1, a known wall mounting bracket 10 is shown. Typically the wall mounting bracket 10 is used to provide a flat surface upon which to mount an electrical fixture or other exterior fitting and to cover the edges of the siding adjacent to the mounting bracket on a wall of a building or structure having a sheathing covered by siding. However, the wall mounting bracket 10 may also be used in association with dryer vents, pipes and other "through wall" protrusions or openings.

Figure 12:
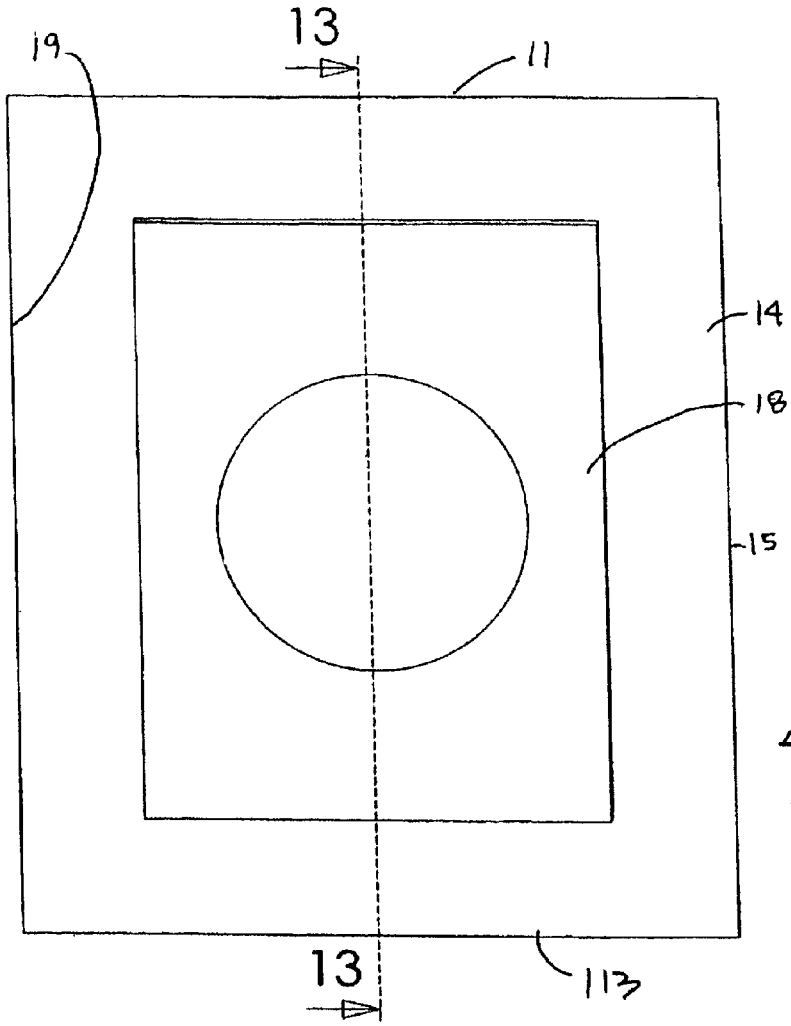
FIG. 12 is a front elevational view showing the water deflecting apparatus of FIG. 2 and the wall mounting bracket of FIG. 1.

The wall mounting bracket 10 is generally rectangular in this example and has a top side 11, a bottom side 113, a right side 15 and a left side 19. The terms "top, bottom, right and left" are used in relation to the positions shown in FIG. 1 as when the wall mounting bracket 10 is mounted on the wall and as shown in FIG. 12 as when the wall mounting bracket 10 is mounted on the wall in association with a water deflecting apparatus 38 as disclosed herein. The distance between right side 15 and the left side 19 defines a first extent A of the wall mounting bracket 10. The first extent A is along a generally horizontal plane when the wall mounting bracket 10 is mounted to the wall. The distance between the top side 11 and the bottom 113 defines a second extent B of the wall mounting bracket 10. The second extent B is along a generally vertical plane when the wall mounting bracket 10 is mounted to the wall.

The exemplary wall mounting bracket 10 is bipartite and comprised of a mounting plate 12 and a cover plate 14. The mounting plate 12 has a front surface 16 and a back surface 13 which is opposite the front surface 16 and similar in shape. The back surface 13 abuts the wall when the wall mounting bracket 10 is mounted to the wall. A plurality of openings 17 extend through the mounting plate 12 and may receive fasteners such as nails to facilitate mounting the wall mounting bracket 10 on the wall. There is a protrusion 18 extending outwardly from the front surface 16 of the mounting plate 12. The protrusion 18 has a peripheral wall 20 that extends outwardly from the front surface 16 and a planar front wall 22 at an outward end 24 of the peripheral wall 20. There is an opening 26, circular in this example, for extending about an electrical fixture when the wall mounting bracket 10 is mounted to the wall.

The cover plate 14 has a front surface 28, a back surface 29 which is opposite the front surface 28 and similar in shape and an opening 30. A flange member 32 extends outwardly from the back surface 29 of the cover plate 14 at a periphery 34 of the opening 30. The flange member 32 is releasably telescoped over the protrusion 18 as indicated by lines 36 to bring the front surface 28 of the cover plate 14 substantially flush with the planar front wall 22 of the protrusion 18. When the flange member 32 is telescoped over the protrusion 18, the back surface 29 of the cover plate 14 is spaced-apart from the front surface 16 of the mounting plate 12 forming a passageway for insertion of siding panels.

Figure 2:
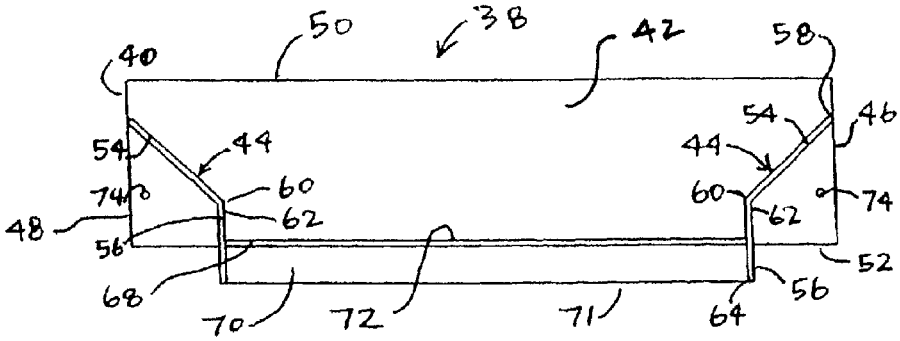
FIG. 2 is a front elevational view showing a water deflection apparatus according to an embodiment of the invention.
Figure 4:
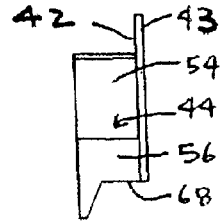
FIG. 4 is a side elevational view showing the water deflection apparatus of FIG. 2.
Figure 3:
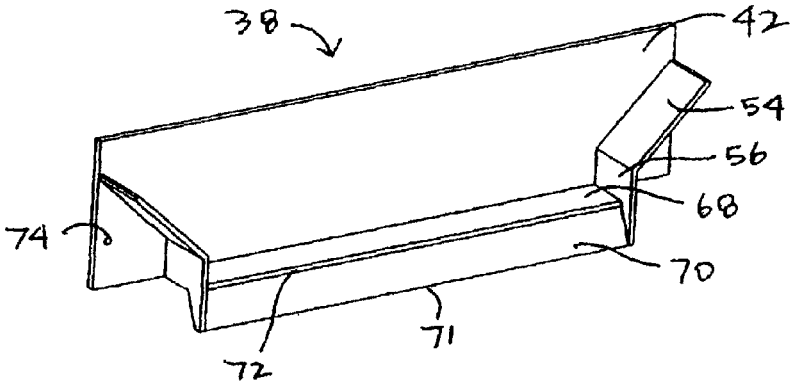
FIG. 3 is a front isometric view showing the water deflection apparatus of FIG. 2.
Figure 9:
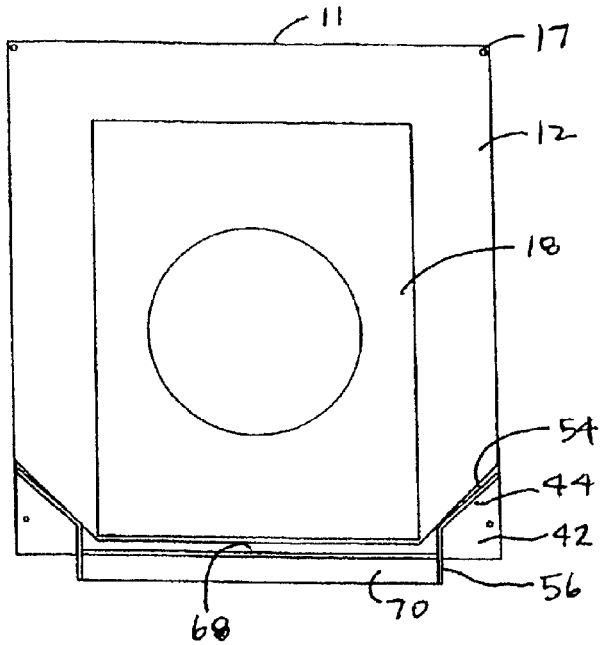
FIG. 9 is a front elevation view showing the water deflecting apparatus of FIG. 2 in conjunction with the mounting plate of the wall bracket of FIG. 8.

Referring now to FIGS. 2, 3 and 4 a water deflecting apparatus 38 separate from and for use with the wall mounting bracket 10 is shown according to an embodiment of the invention. The water deflecting apparatus 38 has mounting plate 40 with a front surface 42, a back surface 43, a top 50 and a bottom 52. The terms "top and bottom" are used in relation to the positions shown in FIG. 2 when the water deflecting apparatus 38 is mounted on the wall alone, and as best shown in FIG. 9 when the water deflecting apparatus 38 is mounted on the wall in association with the mounting plate 12 of wall mounting bracket 10.

The mounting plate 40 is elongate and has a length generally equal to the first extent A of the wall mounting bracket 10. At each end 46 and 48 of the mounting plate 40 there is a deflector 44 which extends outwardly from the front surface 42 thereof. The deflectors 44 each have a first portion 54 and a second portion 56. In the embodiment of invention shown in FIGS. 2, 3 and 4 the first portions 54 of the deflectors 44 are in the form of flanges extending perpendicularly from the front surface 42 of the mounting plate 40. The first portion 54 of each said deflector 44 runs from a top edge 58 downwardly and inwardly to a bottom edge 60, as best shown in FIG. 2. The top edge 58 of the first portion 54 of each said deflector 44 is located generally adjacent respective ones of said ends 46 and 48 of the mounting plate 40. The bottom edge 60 of the first portion 54 of each said deflector 44 is located inwardly of the respective ones of said ends 46 and 48 of the mounting plate 40. In this example the first portions 54 of each said deflector 44 extend at an angle of about 45° with the vertical when the water deflecting apparatus 38 is in use, however, this may vary in other embodiments.

The second portion 56 of each said deflector 44 is also in the form of a flange extending perpendicularly from the front surface 42 of the mounting plate 40 and is inset from the respective ones of said ends 46 and 48 of the mounting plate 40. The second portion 56 of each said deflector 44 runs from a top edge 62 downwardly and generally vertically to a bottom edge 64, as best shown in FIG. 2. The top edge 62 of the second portion 56 of each said deflector 44 is located below the top edge 58 of the first portion 54 of said each deflector 44. In the embodiment of the invention shown in FIGS. 2, 3 and 4 the top edge 62 of the second portion 56 of each said deflector 44 is integral with the bottom edge 60 of the first portion 54 of said each deflector 44. However, it would be understood by a person skilled in the art that the first portion 54 and second portion 56 of each said deflector 44 may be offset. In this example the second portions 56 of each said deflector 44 are vertically oriented when the water deflecting apparatus 38 is in use, however, the second portions 56 may be angled differently in other embodiments.

There is a web 68 extending outwardly from the front surface 42 of the mounting plate and between the respective second portions 56 of deflectors 44. A skirt 70 extends outwardly and downwardly from an outward side edge 72 of the web 68 at an angle of about 45° with the horizontal when the water deflecting apparatus 38 is in use, however, this may vary in other embodiments. The outward side edge 71 of the skirt 70 is below the bottom 52 of the mounting plate 40. A plurality of openings 74 extend through the mounting plate 40 and may receive fasteners such as nails to facilitate mounting the water deflecting apparatus 38 to the wall.

Figure 5:
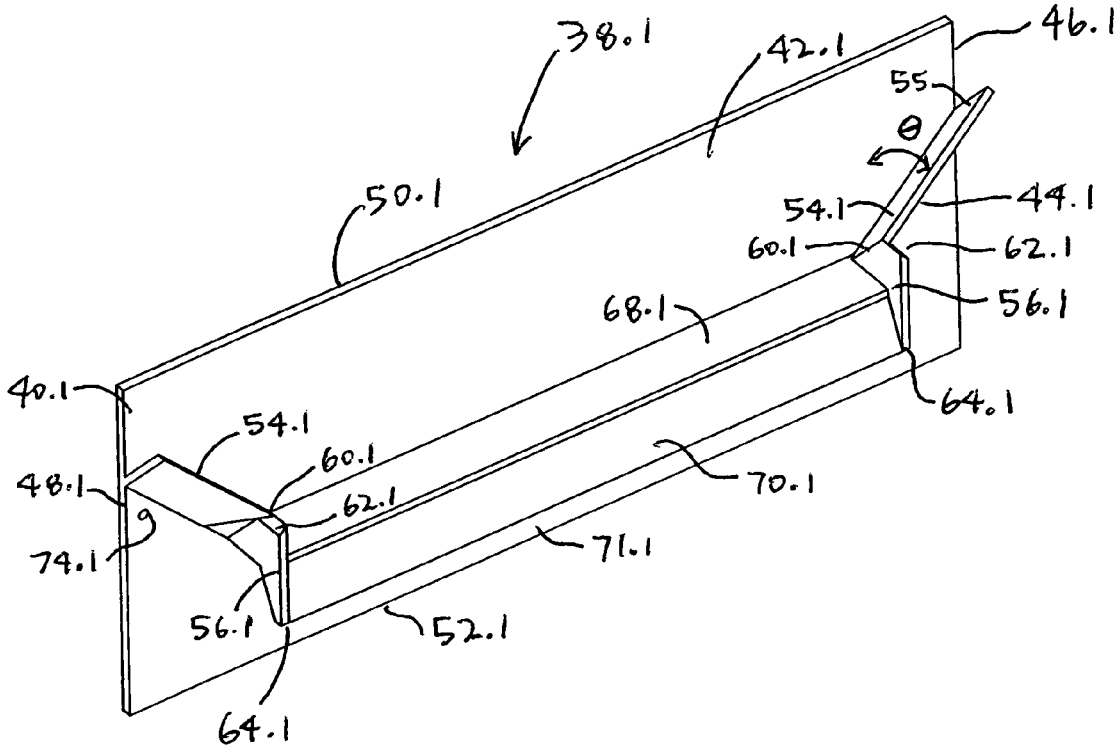
FIG. 5 is a front isometric view showing a water deflection apparatus according to another embodiment of the invention.

Referring now to FIG. 5 a water deflecting apparatus 38.1 for the wall mounting bracket 10 is shown according to another embodiment of the invention wherein like parts have been given like reference numerals with the additional designation "0.1". The water deflecting apparatus 38.1 shown in FIG. 5 is generally similar to the water deflecting apparatus 38 shown in FIGS. 2, 3 and 4. However, in the water deflecting apparatus 38.1 of FIG. 5 the outward side edge 71.1 of the skirt 70.1 is above the bottom 52.1 of the mounting plate 40.1. Furthermore, the first portion 54.1 of the each said deflector 44.1 extends angularly and upwardly from the mounting plate 40.1 forming an inner angle θ of less than 90° between the first portion 54.1 of each said deflector 44.1 and the front surface 42.1 of the mounting plate 40.1. This configuration of the first portion 54.1 may increase the efficiency of water deflection. Although the embodiment of FIG. 5 shows the first portion 54.1 of each said deflector 44.1 having a flat side surface 55, it would be understood by a person skilled in the art that the first portion 54.1 of each said deflector 44.1 may have an upwardly facing curved surface.

Figure 6:
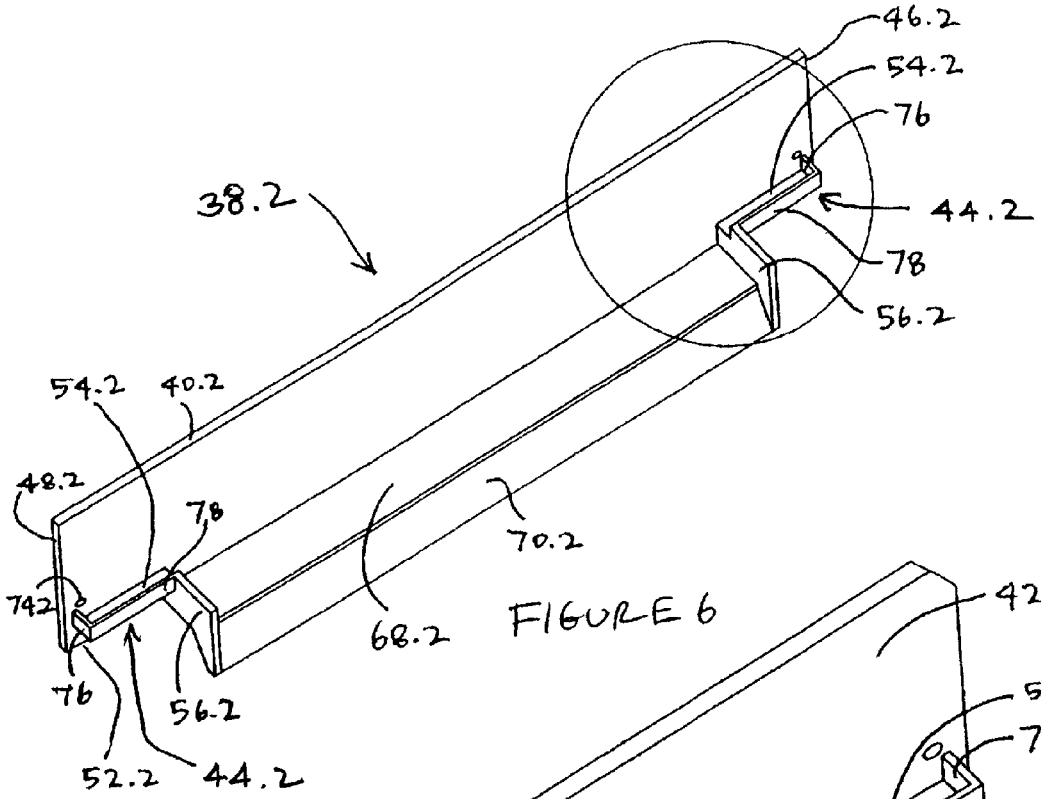
FIG. 6 is a front isometric view showing a water deflection apparatus according to yet another embodiment of the invention.
Figure 7:
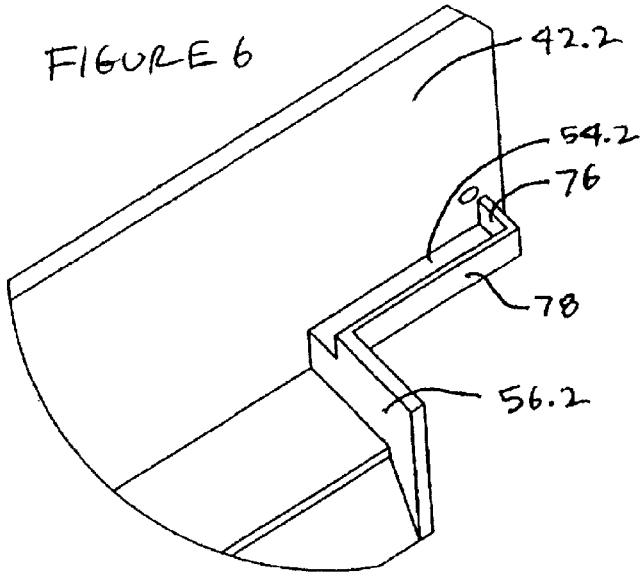
FIG. 7 is a magnified front isometric view showing a deflector of the water deflection apparatus of FIG. 6.

Referring now to FIGS. 6 and 7 a water deflecting apparatus 38.2 for the wall mounting bracket 10 is shown according to yet another embodiment of the invention wherein like parts have been given like reference numerals with the additional designation "0.2". The water deflecting apparatus 38.2 shown in FIGS. 6 and 7 is generally similar to the water deflecting apparatus 38 shown in FIGS. 2, 3 and 4. However, the first portion 54.2 of the each said deflector 44.2 is in the form of an open ended trough having an end wall 76 and a side wall 78 which is spaced-apart from the front surface 42.2 of the mounting plate 40.2. Although the embodiment of FIGS. 6 and 7 shows the first portions 54.2 of each said side deflector as being generally horizontal troughs, it would be understood by a person skilled in the art that the troughs may be inclined.

The water deflection apparatus of the present invention in its preferred embodiment will be made in a single piece from plastic, metal or fibreglass and may be a separate unit which is mounted underneath a wall mounting bracket or may be integral to the wall mounting bracket, and may also be trimmed by an installer so it does not interfere with the installation of siding and is aesthetically pleasing.

Figure 8:
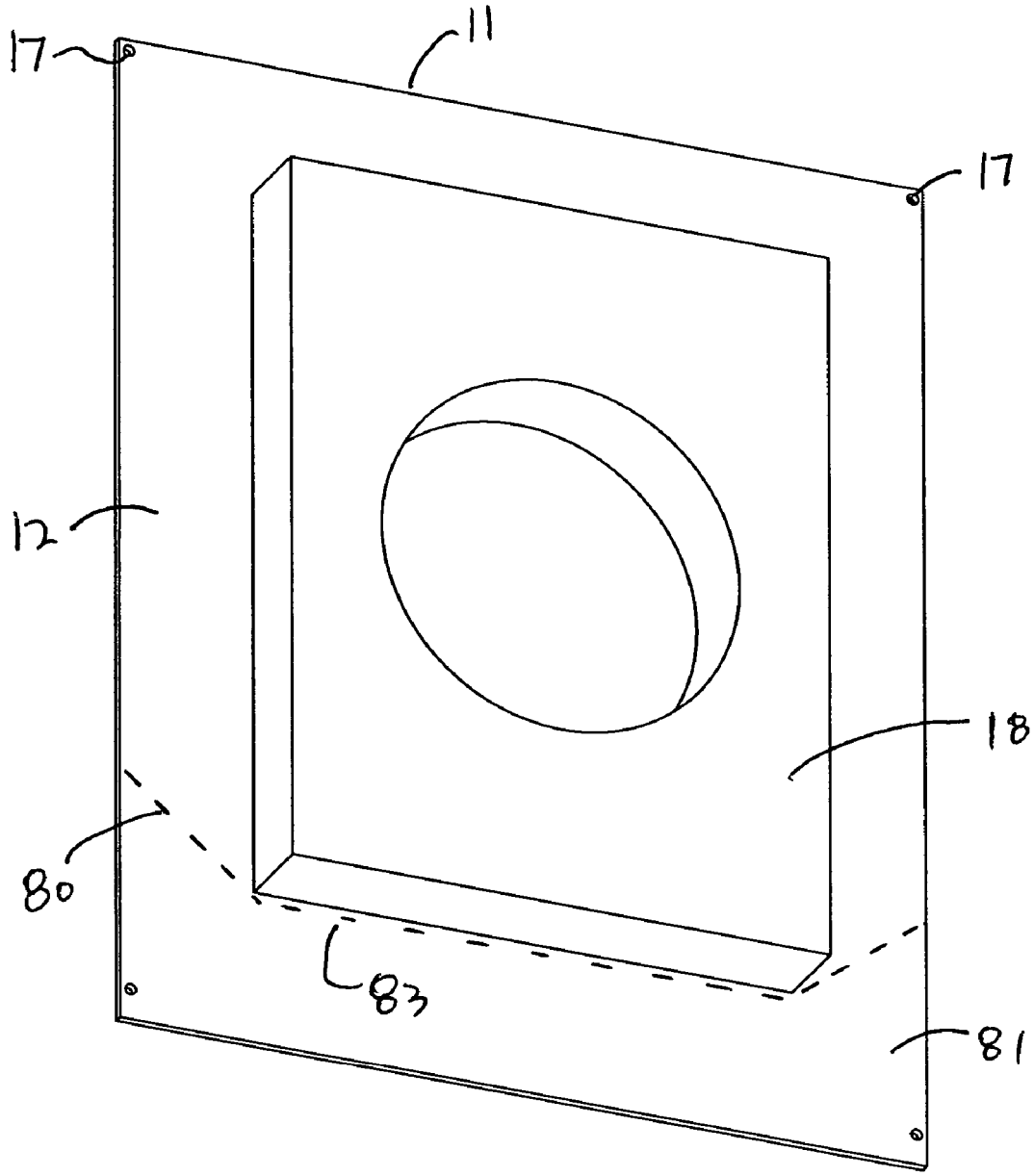
FIG. 8 is front isometric view showing a mounting plate of the wall mounting bracket shown in FIG. 1.
Figure 11:
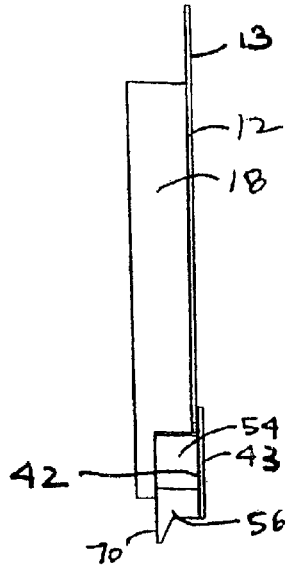
FIG. 11 is a side elevational view showing the water deflecting apparatus of FIG. 2 in conjunction with the mounting plate of the wall bracket of FIG. 8.
Figure 10:
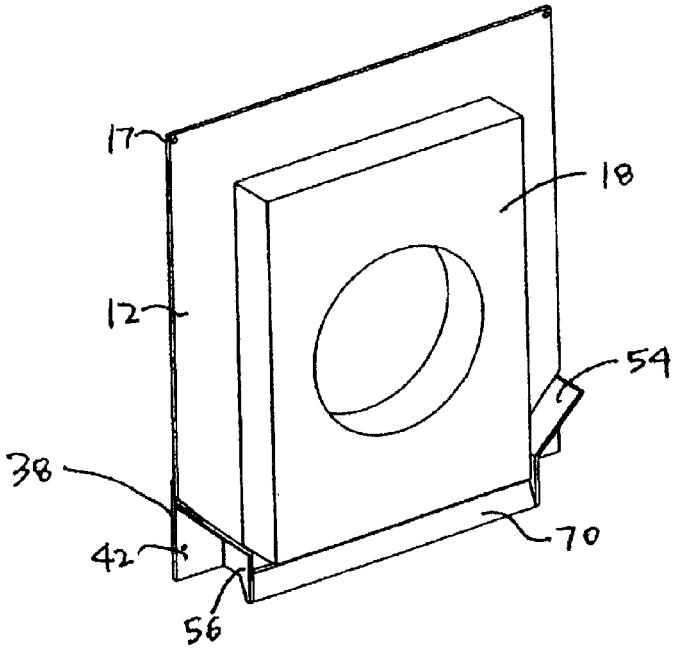
FIG. 10 is a front isometric view showing the water deflecting apparatus of FIG. 2 in conjunction with the mounting plate of the wall bracket of FIG. 8.

In operation the invention functions as follows:

An installer cuts the mounting plate 12 of the wall mounting bracket 10, as shown in FIG. 8, along broken line 80 and removes a bottom portion 81 of the mounting plate 12. The "new" bottom 83 of the mounting plate has a generally horizontal bottom with angled ends and can be received between the deflectors 44 of the water deflecting apparatus 38 as best shown in FIGS. 9 to 11, with a portion of mounting plate 12 overlapping a portion of front surface 42 of water deflecting apparatus mounting plate 40. Alternatively, the mounting plate 12 may be manufactured with a generally horizontal bottom having angled ends thereby eliminating the need for the installer to cut the mounting plate 12.

The water deflecting apparatus 38 is mounted to the sheathing of the wall at a desired location below an electrical fixture using fasteners such as nails which extend through the openings 74 located on the mounting plate 40 of the water deflecting apparatus 38. The "new" bottom 83 of the mounting plate 12 of the wall mounting bracket 10 is placed between the deflectors 44 and in front of the mounting plate 40 of the water deflecting apparatus 38. Thus, as shown in the Figures, a portion of back surface 13 of mounting plate 12 is superposed upon a portion of front surface 42 of mounting plate 40. The mounting plate 12 of the wall mounting bracket 10 is mounted to the sheathing of the wall at the desired position around the electrical fixture location using fasteners such as nails which extend through openings 17 located on the mounting plate 12 of the wall mounting bracket 10.

Figure 13:
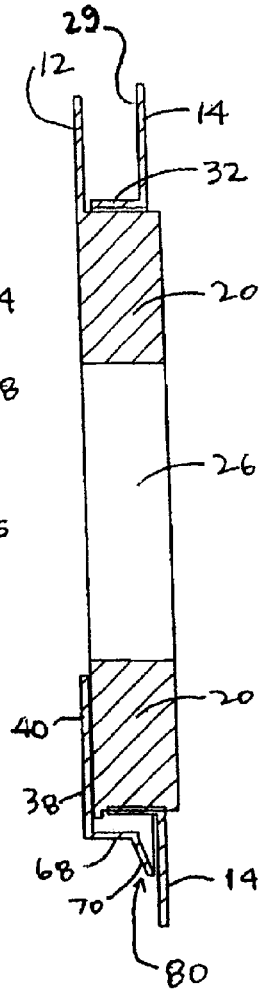
FIG. 13 is a cross-sectional view of FIG. 12 taken across line 13-13.

The flange member 32 of the cover plate 14 of the wall mounting bracket 10 is telescoped over the protrusion 18 of the mounting plate 12 of the wall mounting member 10 to conceal the water deflection apparatus 38 as best shown in FIG. 12. FIG. 13 shows a cross-section of FIG. 12 taken along line 13-13 showing the water deflecting apparatus 38 behind the cover plate 14 of the wall mounting bracket 10. When the flange member 32 is telescoped over the protrusion 18, the back surface 29 of the cover plate 14 is spaced-apart from the front surface 16 of the mounting plate 12 forming a passageway therebetween as described earlier.

Siding is installed on the sheathing around the protrusion 18 of wall mounting bracket 10 and on the sheathing behind the skirt 70 of the water deflection apparatus 38 in the space generally indicated by reference numeral 80 in FIG. 13. Water flows along the siding and around the electrical fixture in the passageway formed between front surface 16 of the mounting plate 12 of the wall mounting bracket 10 and the back surface 29 of the cover plate 14 of the wall mounting bracket 10. The water cascading down the passageway is deflected by the deflectors 44 of the water deflecting apparatus 38 to the skirt 70 of the water deflecting apparatus. The water is then directed by the skirt 70 of the water deflecting apparatus 38 over the top of siding directly below the wall mounting bracket 10 thereby reducing water damage by preventing the water flow behind the siding.

Figure 14:
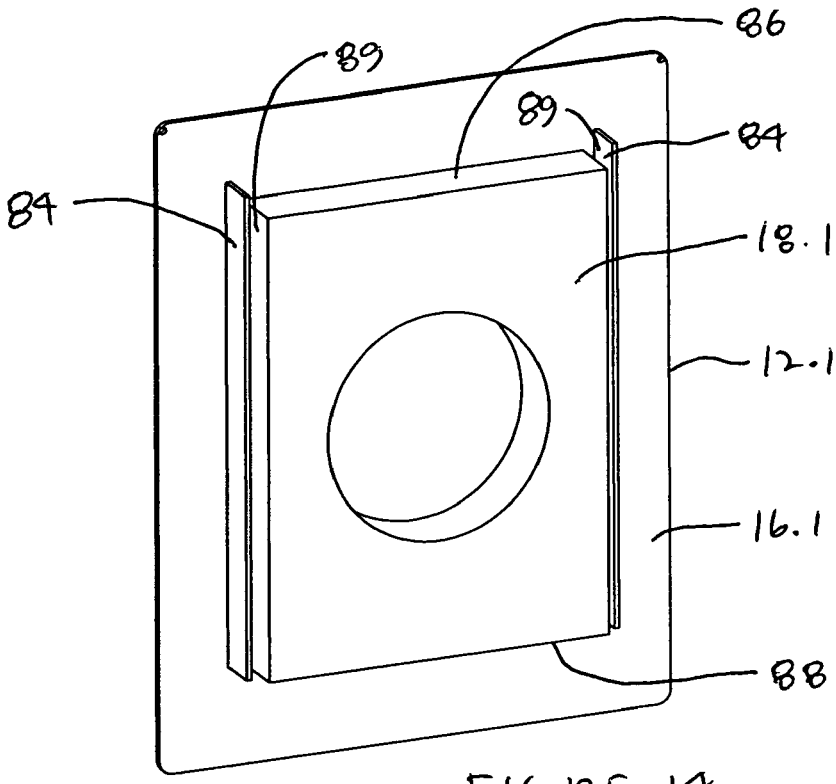
FIG. 14 is front isometric view showing a mounting plate of a wall bracket having a flange extending from a front surface thereof.
Figure 17:
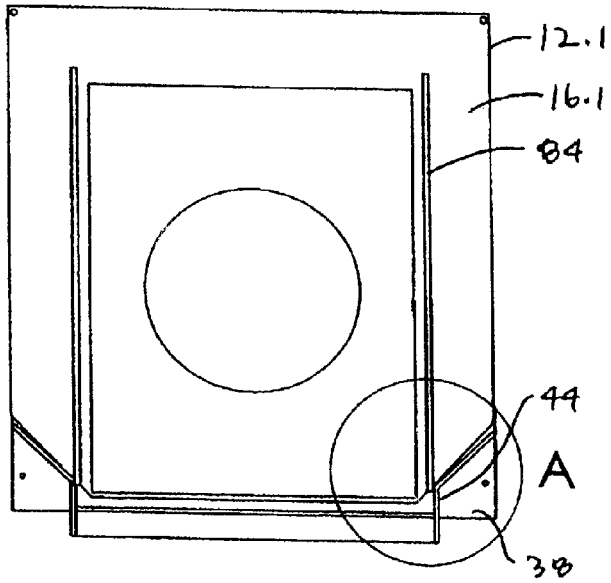
FIG. 17 is a front elevational view showing the water deflecting apparatus of FIG. 2 in conjunction with the mounting plate of FIG. 14.

The present invention may also be used in association with a wall mounting bracket having a mounting plate such as mounting plate 12.1 shown in FIG. 14 wherein like parts have been given like numerals with additional numerical designation "0.1". The mounting plate 12.1 further includes at least one flange 84 extending outwardly from a front surface 16.1 thereof. The flange 84 is spaced-apart from a protrusion 18.1 and extends from near a top end 86 of the protrusion 18.1 to near a bottom end 88 of the protrusion 18.1 and defines a passageway 89 therebetween. The terms "top and bottom" are used in relation to the positions shown in FIG. 15 as when the mounting plate 12.1 of the wall mounting bracket is mounted on the wall and as shown in FIG. 17 as when the mounting plate 12.1 of the wall mounting bracket is mounted on the wall is association with a water deflecting apparatus 38 as disclosed herein.

Figure 15:
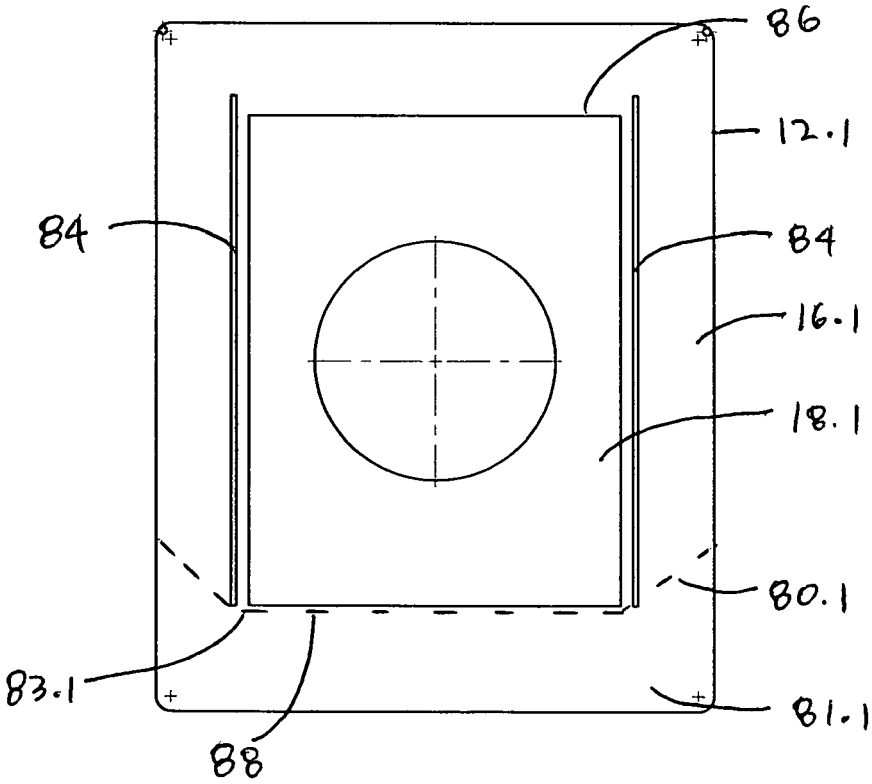
FIG. 15 is front elevation view showing the mounting plate of FIG. 14.
Figure 16:
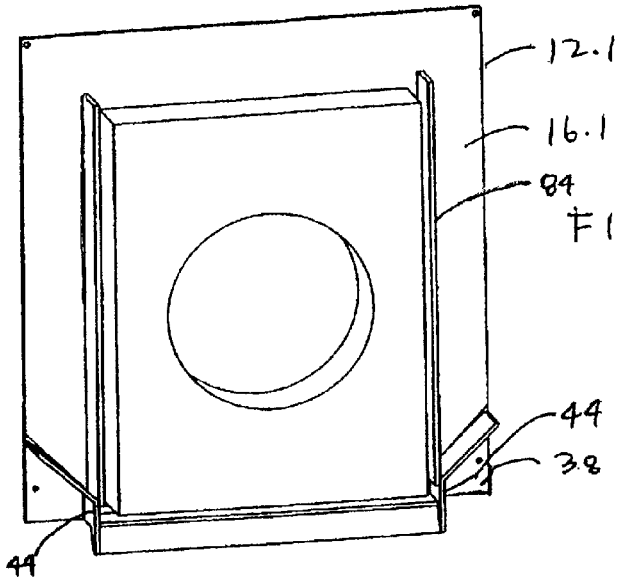
FIG. 16 is a front isometric view showing the water deflecting apparatus of FIG. 2 in conjunction with the mounting plate of FIG. 14.
Figure 18:
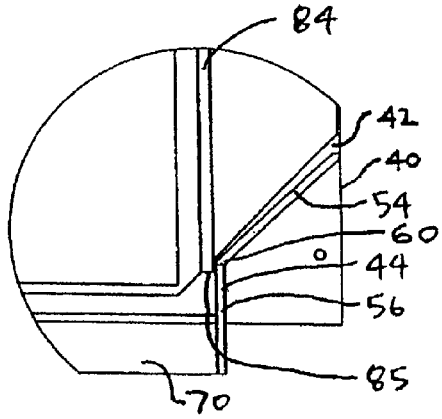
FIG. 18 is a magnified front elevation side showing a deflector of the water deflecting apparatus of FIG. 2 in conjunction flange of the mounting plate of FIG. 14.

An installer cuts the mounting plate 12.1, as shown in FIG. 15 along broken line 80.1 and removes a bottom portion 81.1 of the mounting plate 12.1. The "new" bottom 83.1 of the mounting plate has generally horizontal bottom with angled ends and can be received between the deflectors 44 and in front of the mounting plate 40 of the water deflecting apparatus 38 as best shown in FIGS. 16 and 17. Alternatively, the mounting plate 12.1 may be manufactured with a generally horizontal bottom with angled ends thereby eliminating the need for the installer to cut the mounting plate. Thus, as shown in the Figures, a portion of the back surface of mounting plate 12.1 is superposed upon a portion of front surface 42 of mounting plate 40. As best shown in FIG. 18, when the mounting plate 12.1 of the wall mounting bracket is placed between the deflectors 44 of the mounting plate 40 of the water deflection apparatus 38 a bottom end 85 of the flange 84 is below the bottom edge 60 of the first portion 54 of the deflector 44.

Figure 19:
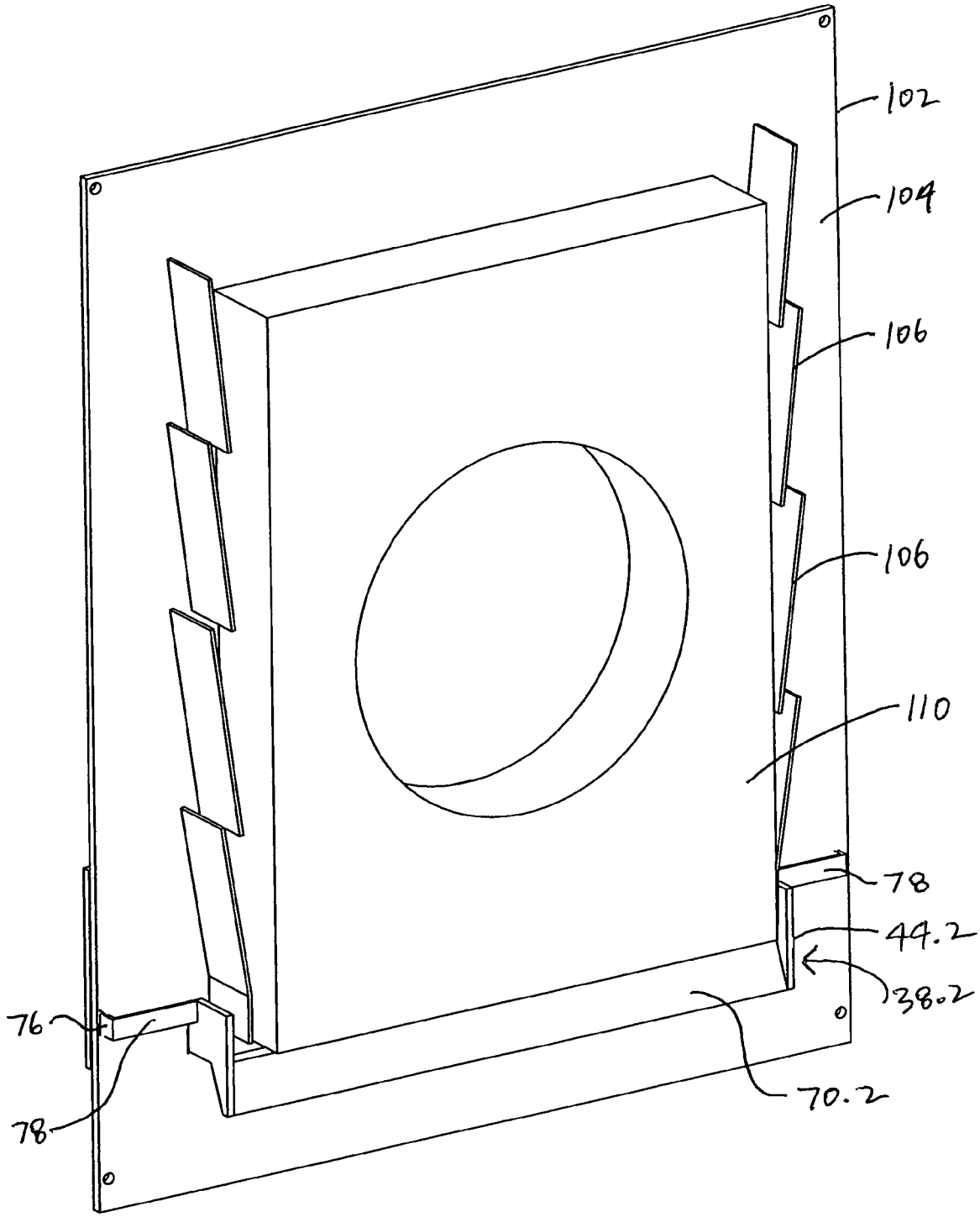
FIG. 19 is front isometric view showing a water deflecting apparatus that is integral with a mounting plate of a wall mounting bracket.

As best shown in FIG. 19 the present invention may also be integral with a wall mounting bracket. In the embodiment of FIG. 19 a water deflecting apparatus 38.2 is integral with the front surface 104 of a mounting plate 102 of a wall mounting bracket. The wall mounting plate 102 of the wall mounting bracket further comprises a plurality of flanges 106 extending from the front surface 104 of mounting plate and being spaced-apart from a protrusion 110. The flanges 106 guide water flow to the water deflecting apparatus.

It will be understood by a person skilled in the art that although the present invention is herein described as being used in conjunction with a wall mounting bracket it may also be used in conjunction with a door, a window or other wall mounted fixtures that create an opening in the siding surface.

It will further be understood by someone skilled in the art that many of the details provided above are given by way of example only and can be altered or deleted without departing from the scope of the invention as set out in the claims.

What is claimed is:

1. A water deflection apparatus separate from and for use with a wall mounting bracket when the water deflecting apparatus and the wall mounting bracket are both mounted to a wall, the wall mounting bracket having a mounting plate and a cover plate, the mounting plate and the cover plate of the wall mounting bracket spaced-apart and a downward flow of water allowed therebetween, the downward flow of water being deflected away from the wall by said water deflecting apparatus, said water deflecting apparatus comprising:

a mounting plate with first and second ends, a back surface and a front surface, said back surface of said mounting plate of said water deflecting apparatus abutting the wall when said water deflecting apparatus is mounted to the wall;

a deflector extending outwardly from said front surface of said mounting plate of said water deflecting apparatus near each said end of said mounting plate of said water deflecting apparatus, the mounting plate of the wall mounting bracket received between said deflectors when said water deflecting apparatus and the wall mounting bracket are both mounted to the wall, a portion of the mounting plate of the wall mounting bracket superposed upon said front surface of said mounting plate of said water deflecting apparatus when said water deflecting apparatus and the wall mounting bracket are both mounted to the wall; and a skirt extending between said deflectors and outwardly from said front surface of said mounting plate of said water deflecting apparatus, said skirt located below the mounting plate of the wall mounting bracket when said water deflecting apparatus and the wall mounting bracket are both mounted to the wall.

2. The water deflecting apparatus as claimed in claim 1 wherein each said deflector is comprised of a first portion and a second portion, said first portion of each said deflector located below the mounting plate of the wall mounting bracket when said water deflecting apparatus and the wall mounting bracket are both mounted to the wall.

3. The water deflecting apparatus as claimed in claim 2 wherein said first portion and said second portion of each said deflector are integral.

4. The water deflecting apparatus as claimed in claim 2 wherein, respective to each said deflector, said first portion is offset with respect to said second portion.

5. The water deflecting apparatus as claimed in claim 2 wherein said first portion of each said deflector has a top edge located near a respective end of said mounting plate of said water deflecting apparatus and a bottom edge located inset from said respective end of said mounting plate of said water deflecting apparatus.

6. The water deflecting apparatus as claimed in claim 5 wherein said first portion of each said deflector is in the form of a flange.

7. The water deflecting apparatus as claimed in claim 5 wherein said first portion of each said deflector is in the form of a trough.

8. The water deflecting apparatus as claimed in claim 5 wherein said second portion of each said deflector is inset from respective ones of said ends of said mounting plate of said water deflection apparatus and runs from a top edge of said deflector second portion downwardly to a bottom edge of said deflector second portion.

9. The water deflecting apparatus as claimed in claim 5 wherein said second portion of each said deflector is located below top edge of first portion of said deflector.

10. The water deflecting apparatus as claimed in claim 2 further including a web extending between said deflectors and outwardly from said front surface of said mounting plate of said water deflecting apparatus.

11. The water deflecting apparatus as claimed in claim 10 wherein said skirt extends from an outward edge of said web.

12. The water deflecting apparatus as claimed in claim 1 wherein said deflectors are located between the mounting plate of the wall mounting bracket and the cover plate of the wall mounting bracket.

13. The water deflecting apparatus as claimed in claim 1 wherein the mounting plate of the wall mounting bracket further includes a protrusion and at least one flange extending outwardly from a front surface of the mounting plate of the wall mounting bracket, the flange being spaced-apart from the protrusion and defines a passageway between the flange and the protrusion, the flange having a bottom end that is disposed between said deflectors.

14. The water deflecting apparatus as claimed in claim 13 wherein the flange is one of a plurality of partially overlapping flanges located along a substantially vertical lateral side surface of the protrusion, each flange of the plurality of flanges having an upper end and a lower end, the upper end of each flange being outwardly offset with respect to the lower end of that flange.

15. The water deflecting apparatus as claimed in claim 14, further comprising a plurality of partially overlapping flanges located along opposed substantially vertical lateral sides of the protrusion, at least one flange of each plurality of overlapping flanges having a bottom end that is disposed between said deflectors.

16. The water deflecting apparatus as claimed in claim 13 wherein the flange extends from near a top end of the protrusion to near a bottom end of the protrusion, the bottom end of the protrusion superposed upon said front surface of said water deflecting apparatus.

17. In combination with a wall mounting bracket having a mounting plate adapted for being mounted to a wall, and a cover plate, the mounting plate and cover plate of the wall mounting bracket being spaced apart and a downward flow of water being allowed therebetween, the improvement which comprises:

a water deflecting apparatus adapted for being mounted to the wall separately from the mounting plate of the wall mounting bracket, said water deflecting apparatus including a mounting plate having a front surface over a portion of which is superposed a portion of the mounting plate of the wall mounting bracket, the water deflecting apparatus further including a pair of deflectors extending outwardly from its said mounting plate front surface and between which the mounting plate of the wall mounting bracket is disposed when the wall mounting bracket and said water deflecting apparatus are both mounted to the wall, said water deflecting apparatus further including a skirt extending between said pair of deflectors and located below the mounting plate of the wall mounting bracket when the wall mounting plate and said water deflecting apparatus are both mounted to the wall.

18. The combination as claimed in claim 17, wherein the water deflecting apparatus is disposed between the mounting plate and cover plate of the wall mounting bracket

19. The combination as claimed in claim 17, wherein the mounting plate of the wall mounting bracket further includes a protrusion and the improvement further comprises at least one flange extending outwardly from a front surface of the mounting plate of the wall mounting bracket, each flange being spaced-apart from the protrusion, the at least one flange defining a passageway between the at least one flange and the protrusion.

20. The combination as claimed in claim 19 wherein the passageway extends from near a top end of the protrusion to near a bottom end of the protrusion.

* * * * *